US005649669A

United States Patent [19]

Ambrose et al.

[11] Patent Number: 5,649,669

[45] Date of Patent: Jul. 22, 1997

[54] HYDRAULIC SPRING CRUSHER

[75] Inventors: David W. Ambrose, Waukesha; Karl W. Droese, Big Bend, both of Wis.

[73] Assignee: ANI America, Inc., Brookfield, Wis.

[21] Appl. No.: 428,008

[22] Filed: Apr. 24, 1995

[51] Int. Cl.[6] ..... B02C 2/00

[52] U.S. Cl. ..... 241/207; 241/290; 241/DIG. 30

[58] Field of Search ..... 241/207–216, 241/37, 286, 290, DIG. 30, 285.1, 285.2

[56] References Cited

U.S. PATENT DOCUMENTS

| | | | |
|---|---|---|---|
| 3,038,670 | 6/1962 | Becker | 241/290 X |
| 3,339,856 | 9/1967 | Cook | 241/290 |
| 3,700,175 | 10/1972 | Saito | 241/37 |
| 3,754,716 | 8/1973 | Webster | 241/290 X |
| 3,834,633 | 9/1974 | Dougall et al. | 241/295 |
| 4,012,000 | 3/1977 | Davis et al. | 241/290 |
| 4,206,881 | 6/1980 | Werginz | 241/207 |
| 4,215,826 | 8/1980 | Schafer | 241/207 |
| 4,232,833 | 11/1980 | Werginz | 241/37 |
| 4,467,971 | 8/1984 | Schuman | 241/215 |
| 4,477,030 | 10/1984 | Vifian et al. | 241/208 |
| 4,589,600 | 5/1986 | Schuman | 241/215 |
| 4,592,517 | 6/1986 | Zarogatsky et al. | 241/207 |
| 4,615,491 | 10/1986 | Batch et al. | 241/37 |
| 4,717,084 | 1/1988 | Vendelin et al. | 241/207 |
| 4,750,679 | 6/1988 | Karra et al. | 241/41 |
| 4,750,681 | 6/1988 | Sawant et al. | 241/208 |
| 4,787,562 | 11/1988 | Templeton | 241/DIG. 30 X |
| 4,787,563 | 11/1988 | Tanaka et al. | 241/208 |
| 4,793,560 | 12/1988 | Schrodl | 241/30 |
| 4,844,362 | 7/1989 | Revnivtsev et al. | 241/210 |
| 4,892,257 | 1/1990 | Stoeckmann et al. | 241/32 |
| 4,967,967 | 11/1990 | Magerowski et al. | 241/21 |
| 4,976,470 | 12/1990 | Arakawa | 241/37 |
| 5,031,843 | 7/1991 | Motz | 241/21 |
| 5,312,053 | 5/1994 | Ganser, IV | 241/30 |
| 5,350,125 | 9/1994 | Clark | 241/208 |
| 5,372,318 | 12/1994 | Jacobson | 241/207 |
| 5,464,165 | 11/1995 | De Deimar et al. | 241/290 X |

FOREIGN PATENT DOCUMENTS

| | | | |
|---|---|---|---|
| 2309765 | 9/1973 | Germany | 241/286 |
| 1069855 | 1/1984 | U.S.S.R. | 241/DIG. 30 |

*Primary Examiner*—Mark Rosenbaum
*Attorney, Agent, or Firm*—Michael Best & Friedrich

[57] ABSTRACT

A cone crusher having a main frame, a crusher head interconnected with the main frame, a crusher bowl positioned adjacent to the first crusher member, and a double-acting hydraulic lift interconnected with both the main frame and the second crusher member. A force transfer member extends downward relative to the crusher bowl. The hydraulic lift includes an upper end interconnected with the main frame and a lower end interconnected with the force transfer member, thereby providing a downward clamp force on the force transfer member to compliantly clamp the crusher bowl to the main frame in an operating position. The hydraulic lift can provide an upward lift force on the force transfer member to move the second crusher member from the operating position to a clear position.

24 Claims, 9 Drawing Sheets

12
28
16
14
26
48
54
52
50
56
20
22
24
10
30
38
40
36
34
42
32
31
46

HYDRAULIC SPRING CRUSHER

FIELD OF THE INVENTION

The present invention generally relates to the field of crushers used to crush aggregate into smaller pieces. More specifically, the present invention relates to cone crushers having clamp springs for compliantly holding a crusher bowl liner down against a crusher mantle during a crushing operation.

BACKGROUND OF THE INVENTION

Crushers are used to crush large aggregate particles (e.g., rocks) into smaller particles. FIGS. 1 and 2 illustrate one particular type of crusher, known as a cone crusher 12. In the illustrated cone crusher 12, large particles are fed to a feed distributor 14 (FIG. 2) where the particles are distributed into a feed hopper 16. Referring specifically to FIG. 2, the large particles fall into an annular space 18 between a bowl liner 20 and a mantle 22. The bowl liner 20 is secured to a bowl 24 which is threaded to an adjustment ring 26. The threaded interconnection allows the height of the bowl 24 to be adjusted relative to the adjustment ring 26, thereby accommodating a range of particle sizes. Hydraulic lock posts 28 can be used to selectively lock the adjustment ring 26 to the bowl 24.

The adjustment ring 26 is clamped to, but can move vertically relative to, a main frame 30, as described below in more detail. Alignment pins 31 maintain the adjustment ring 26 in alignment with the main frame 30. The mantle 22 is secured to a head 32 which is, in turn, secured to a main shaft 34. The main shaft 34 is eccentrically and rotatably mounted in a eccentric 36 which is, in turn, rotatably mounted in the main frame 30. The eccentric 36 is driven by a countershaft 38 through a pinion 40 that is secured to the countershaft 38 and a gear 42 that is secured to the eccentric 36.

Because of the eccentric mounting of the main shaft 34 (and associated head 32 and mantle 22) within the eccentric 36, the annular space 18 between the bowl liner 20 and the mantle 22 is not uniform. Rather, the space 18 varies about the circumference of the mantle so that the spacing includes a relatively large gap on one side of the mantle and a relatively small gap on the other side of the mantle. When the eccentric 36 is driven, the main shaft 34 (and associated head 32 and mantle 22) circumscribes an annular path (i.e., due to the eccentric mounting), thereby causing the large and small gaps to similarly travel in an annular path. This gyrating motion of the head 32 and the mantle 22 around the main axis of the cone crusher allows the feed material to enter the annular space 18. The material is then impacted and compressed between the mantle 22 and the bowl liner 20 in a series of steps as the material travels further down the annular space 18. The annular space 18 progressively gets smaller, thereby reducing the feed material down to the desired product size.

During crushing operations, it is not uncommon to encounter particles that are difficult to crush, sometimes referred to as "tramp." Small tramp will generally pass through the system without difficulty. However, sometimes even small tramp will become lodged between the mantle 22 and the bowl liner 20. In this situation, by virtue of the vertical movability of the adjustment ring 26, the bowl liner 20 will raise slightly to allow the small tramp to pass through the crusher. Such vertical movability of the adjustment ring 26 (and associated bowl 24 and bowl liner 20) is provided by a coil spring assembly 44 that clamps the adjustment ring 26 to the main frame 30.

In the illustrated crusher 12, the coil spring assembly 44 comprises sixteen coil spring subassemblies 46 circumferentially spaced around the main frame 30. Each coil spring subassembly 46 includes an upper frame flange 48 secured to the main frame 30, a lower spring segment 50, and five coil springs 52 between the upper frame flange 48 and the lower spring segment 50. Three spring bolts 54 extend through the lower spring segment 50, the upper frame flange 48, and the adjustment ring 26. Spring nuts 56 are secured to the lower end of each spring bolt 54. In the illustrated arrangement, the coil springs 52 bear against the underside of the upper frame flange 48, and push down on the lower spring segment 50, which in turn pulls down on the spring bolt 54 and nut 56 and associated adjustment ring 26.

The above-described arrangement affords upward movement of the adjustment ring 26 (and associate bowl 24 and bowl liner 20) against the force of the coil springs 52 in response to engagement of the bowl 24 and mantle 22 with tramp material, thereby allowing small tramp to pass through the system. It should be appreciated that, due to compression of the coil springs 52, any vertical movement of the adjustment ring 26 results in increased pressure being provided by the bowl liner 20 against the particles. The initial clamping force provided by the coil spring assembly 44 (i.e., before the adjustment ring 26 raises from the main frame 30) is on the order of about one million (1,000,000) pounds.

When large tramp particles become lodged in the annular space 18, the pressure created between the tramp, bowl liner 20 and mantle 22 can be so large that it causes the motor (not shown) driving the countershaft 38 to stall. In this situation, the tramp must be cleared by raising the adjustment ring 26 to a clear position, thereby increasing the annular space 18 to allow the tramp to fall or be pushed from the annular space 18.

To raise the adjustment ring 26 to a clear position, the illustrated crusher 12 includes four hydraulic actuators 58 (FIG. 1) that can be extended to push upward on the adjustment ring 26. The hydraulic actuators 58 must provide sufficient force not only to lift the weight of the adjustment ring 26, the bowl 24 and the bowl liner 20, but also to overcome the clamping force of the coil spring assembly 44, which force increases with compression of the springs 52. The force required to raise the adjustment ring can be on the order of about one and a half million (2,500,000) pounds or more. Such high forces require high hydraulic pressures which can lead to blown or leaking hoses.

In addition, there is a limit to the amount that the coil springs 52 can be compressed while raising the adjustment ring 26. This limit is due not only to the spring forces of the assembly that may exceed the maximum force that can be applied by the actuators 58, but also to the limits on compressibility of the coil springs 52 (i.e., the length of the fully compressed coil springs). As an example, the above-described crusher 12 is designed to raise the adjustment ring 26 only about two inches.

SUMMARY OF THE INVENTION

The invention is directed to improvements to cone crushers of the above-described type. In one aspect, the invention includes a cone crusher having a main frame, a first crusher member (e.g., a crusher head) interconnected with the main frame, a second crusher member (e.g., a crusher bowl and an adjustment ring) positioned adjacent to the first crusher member, and a double-acting hydraulic lift interconnected with both the main frame and the second crusher member.

The second crusher member is movable relative to the first crusher member between an operating position and a clear position. The double-acting hydraulic lift can include a cylinder, a manifold extending from the cylinder, and an accumulator extending down from the manifold.

The invention also includes a cone crusher having a main frame, a first crusher member (e.g., a crusher head) interconnected with the main frame, a second crusher member (e.g., a crusher bowl and an adjustment ring) positioned above the first crusher member, a force transfer member interconnected with and extending downward relative to the second crusher member, and a hydraulic spring having an upper end interconnected with the main frame and a lower end interconnected with the force transfer member. The second crushing member is movable relative to the first crusher member between an operating position and a clear position. The hydraulic spring provides a downward clamp force on the force transfer member to compliantly clamp the second crusher member to the main frame during crushing operations. The cone crusher can further include a lower spring segment interconnecting the lower end of the hydraulic spring with the force transfer member. Preferably, the hydraulic spring comprises a double-acting hydraulic lift. That is, the hydraulic spring preferably provides the dual function of acting as a spring in one direction, and acting as a lift in the opposite direction.

The invention further includes a cone crusher comprising a main frame, a first crusher member interconnected with the main frame, a second crusher member positioned adjacent to the first crusher member, a hydraulic spring interconnected with both the main frame and the second crusher member, and an elasto-viscous, resilient pad operatively positioned between the hydraulic spring and the main frame. The second crusher member is movable relative to the first crusher member between an operating position and a clearing position. The hydraulic spring provides a clamp force on the second crushing member to compliantly clamp the second crusher member to the main frame during crushing operations.

In one embodiment, the hydraulic spring is at least partially positioned between first and second flanges of the main frame. Preferably, a first resilient pad is positioned between the hydraulic spring and the first flange, and a second resilient pad is positioned between the hydraulic spring and the second flange. The hydraulic spring may, for example, comprise a double-acting hydraulic lift.

The invention also includes a method of converting a mechanical spring cone crusher to a hydraulic spring cone crusher. The mechanical spring cone crusher includes a main frame, an adjustment ring, at least one spring bolt, at least one mechanical spring, and at least one lower spring segment. The method includes the steps of removing the lower spring segment and the mechanical spring from the cone crusher, securing (e.g., welding) the spring bolt to the adjustment ring, positioning a hydraulic spring assembly adjacent to the main frame, and securing the lower spring segment to both the hydraulic spring assembly and the spring bolt.

DETAILED DESCRIPTION

Figure 1:
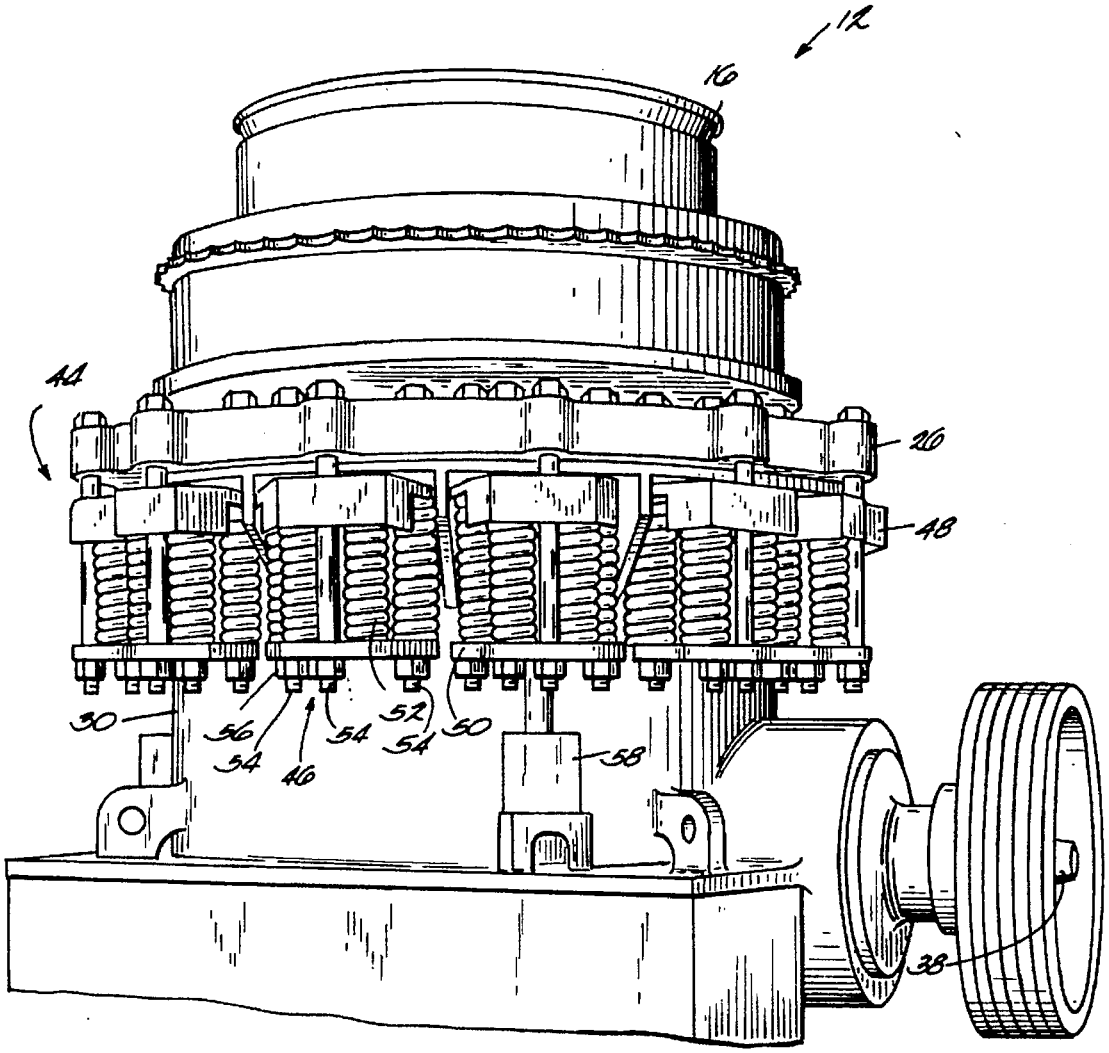
Fig. 1 PRIOR ART
FIG. 1 is a perspective view of a prior art cone crusher.

The present invention is embodied in the cone crusher 60 illustrated in FIGS. 3–8. Similar to the prior art cone crusher 12, the cone crusher 60 illustrated in FIGS. 3–8 includes most of the internal components illustrated in FIG. 2. For example, although not specifically illustrated, the cone crusher 60 includes a countershaft, a pinion, a gear, a main shaft, a head, a mantle, a bowl liner and a bowl. In addition, the cone crusher 60 includes (FIG. 3) an adjustment ring 62, a main frame 64, spring bolts 66, and a hydraulic spring assembly 68. Each of these components is described below in more detail.

The adjustment ring 62 is threaded to the bowl of the cone crusher 60. As noted above, such threaded engagement allows height adjustment of the bowl to achieve a range of spacing between the bowl liner and the mantle. In its resting condition, the adjustment ring 62 butts against a frame seat 70 of the main frame 64.

Figure 4:
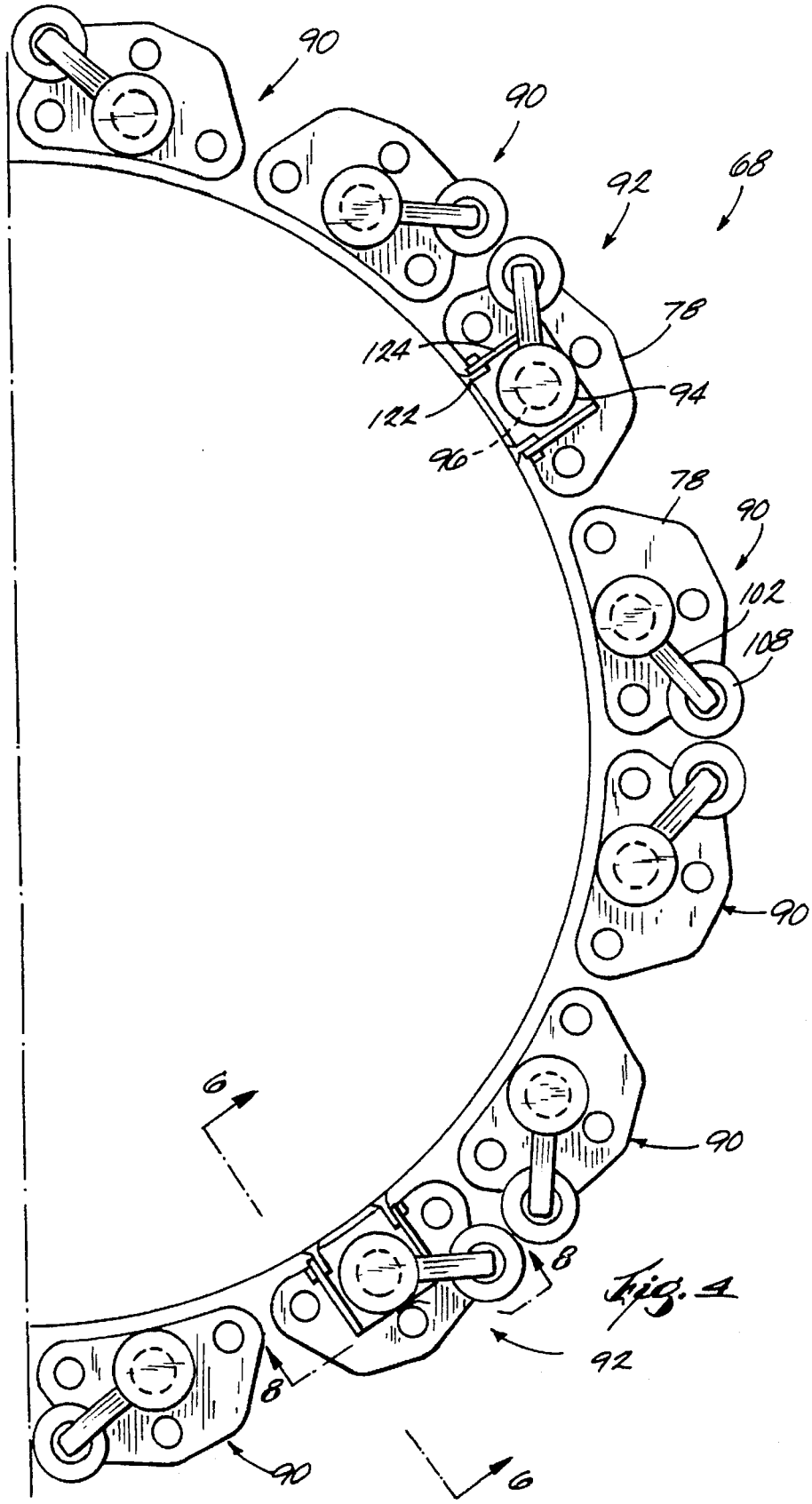
FIG. 4 is a top section view of the cone crusher illustrated in FIG. 3 with the spring bolts removed.
Figure 5:
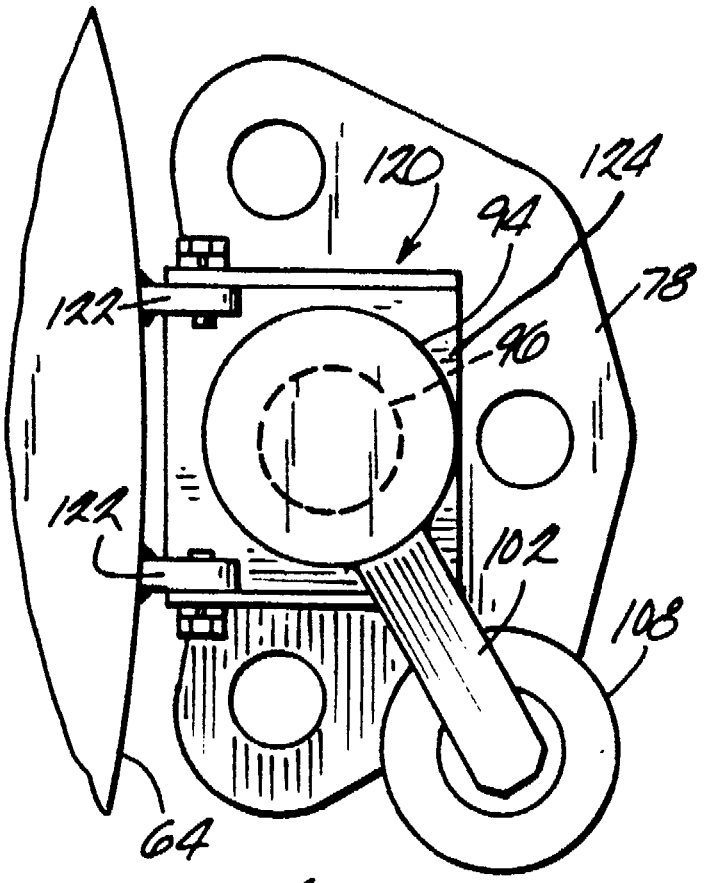
FIG. 5 is an enlarged top view of the spring assembly illustrated in FIG. 4.

The hydraulic spring assembly 68 of the illustrated embodiment includes sixteen spring subassemblies, including twelve single-acting subassemblies 90 and four double-acting subassemblies 92 (FIG. 4). The single-acting subassemblies are operable to apply forces to the adjustment ring 62 in only one direction (i.e., downward), while the double-acting subassemblies can be operated to apply forces to the adjustment ring 62 in two directions (i.e., both upward and downward), as is described below in more detail.

Figure 6:
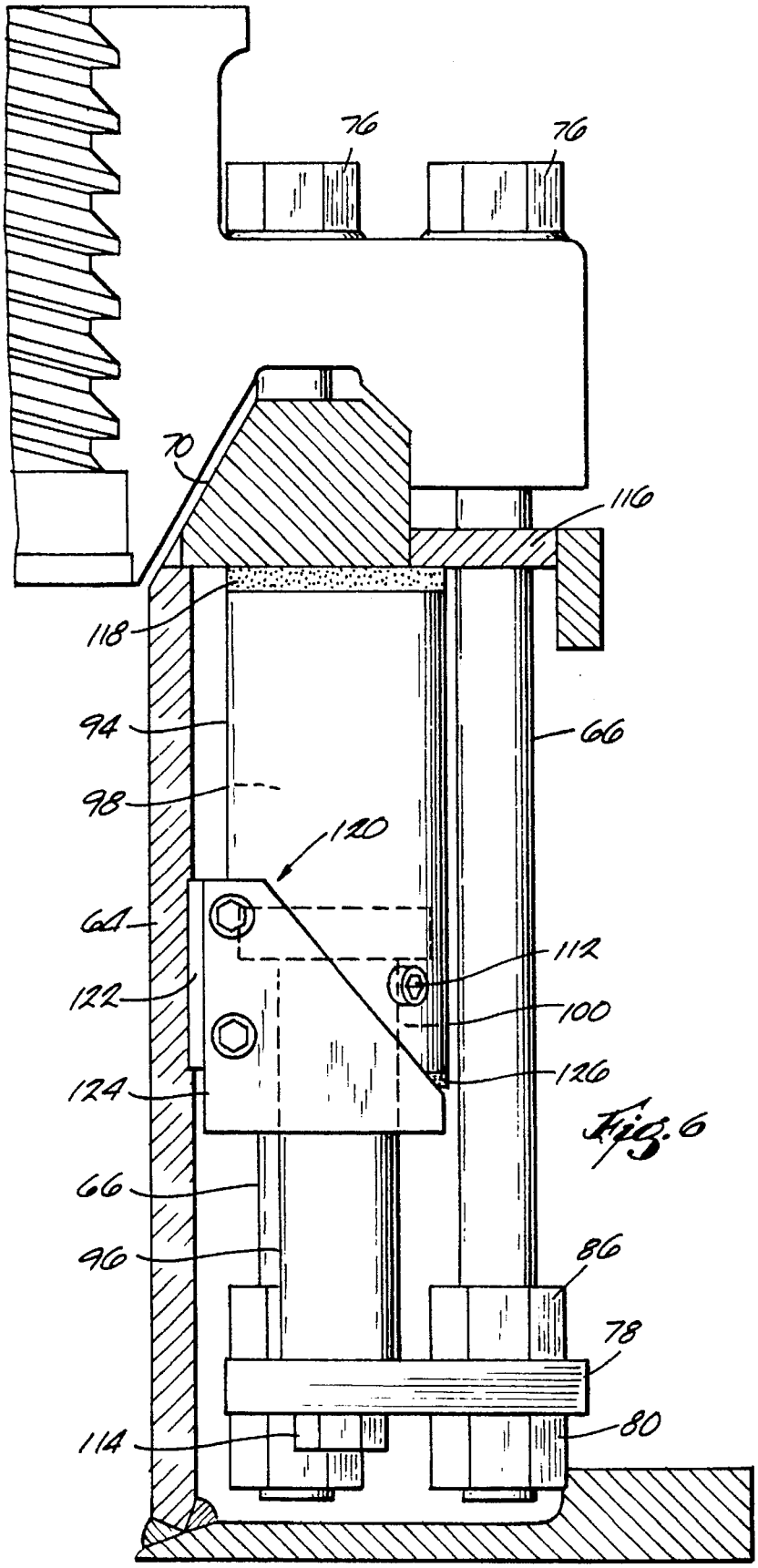
FIG. 6 is a side section view taken along line 6—6 in FIG. 4 and showing the hydraulic spring in the operating position.

Each spring subassembly (i.e., both single-acting and double-acting) includes a cylinder member 94 and a piston member 96 slidably positioned within the cylinder members 94. Each cylinder member 94 and corresponding piston member 96 cooperatively define an upper chamber 98 and a lower chamber 100 in the cylinder member 94 (FIG. 6). A manifold member 102 (FIGS. 5 and 8) extends from each cylinder member 94 and interconnects the upper chamber 98 of each piston-cylinder arrangement with an accumulator 108. The accumulator 108 provides compliant pressure to the hydraulic fluid within the upper chamber 98 by providing a bladder interface (not shown) between the hydraulic fluid and a pressurized gas within the accumulator 108. The illustrated embodiment utilizes a Bosch one gallon accumulator, available from the Robert Bosch Fluid Power Corporation under part number 0 531 113 645, and pressurized to an initial pressure of about 1800 psi.

Figure 2:
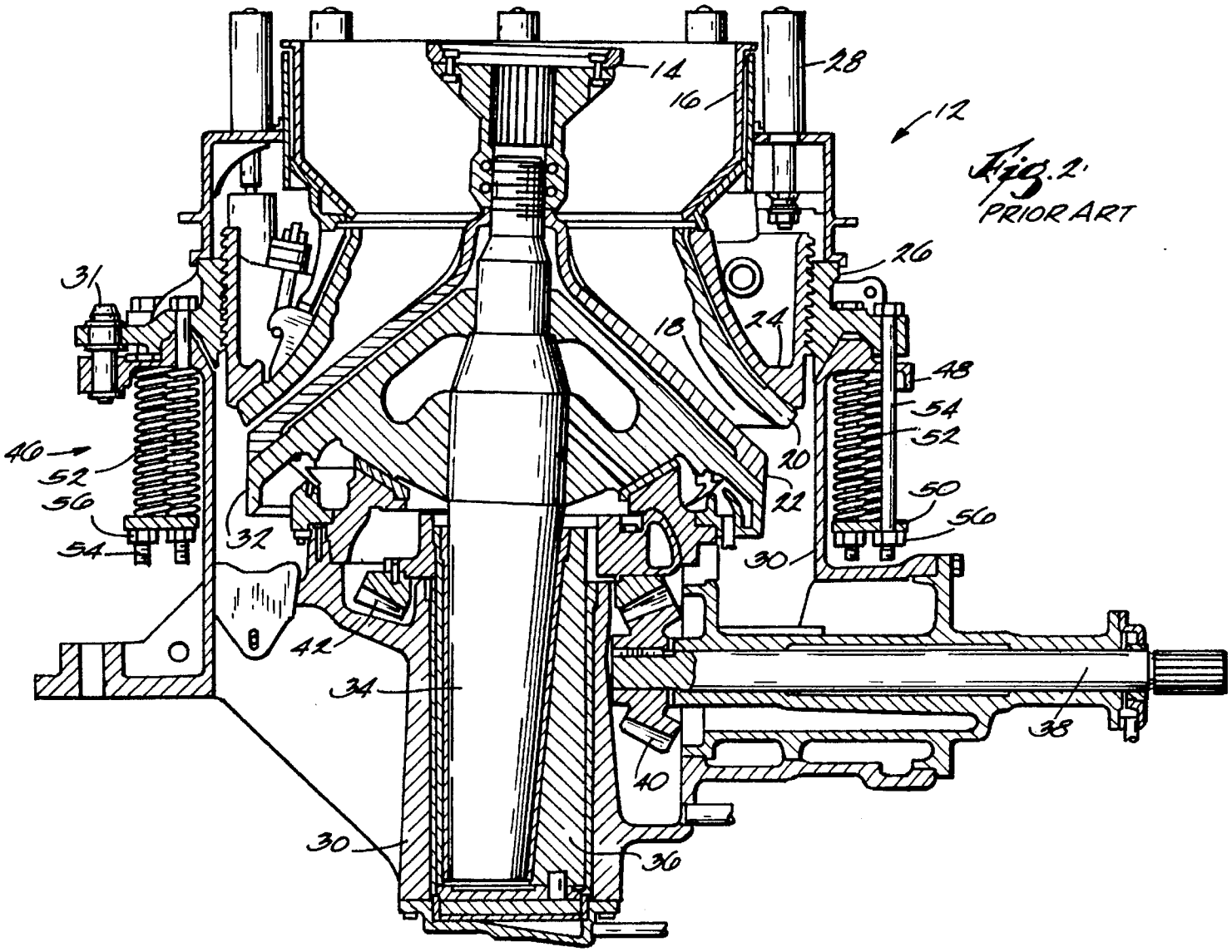
Fig. 2 PRIOR ART
FIG. 2 is a side section view of the prior art cone crusher illustrated in FIG. 1.
Figure 3:
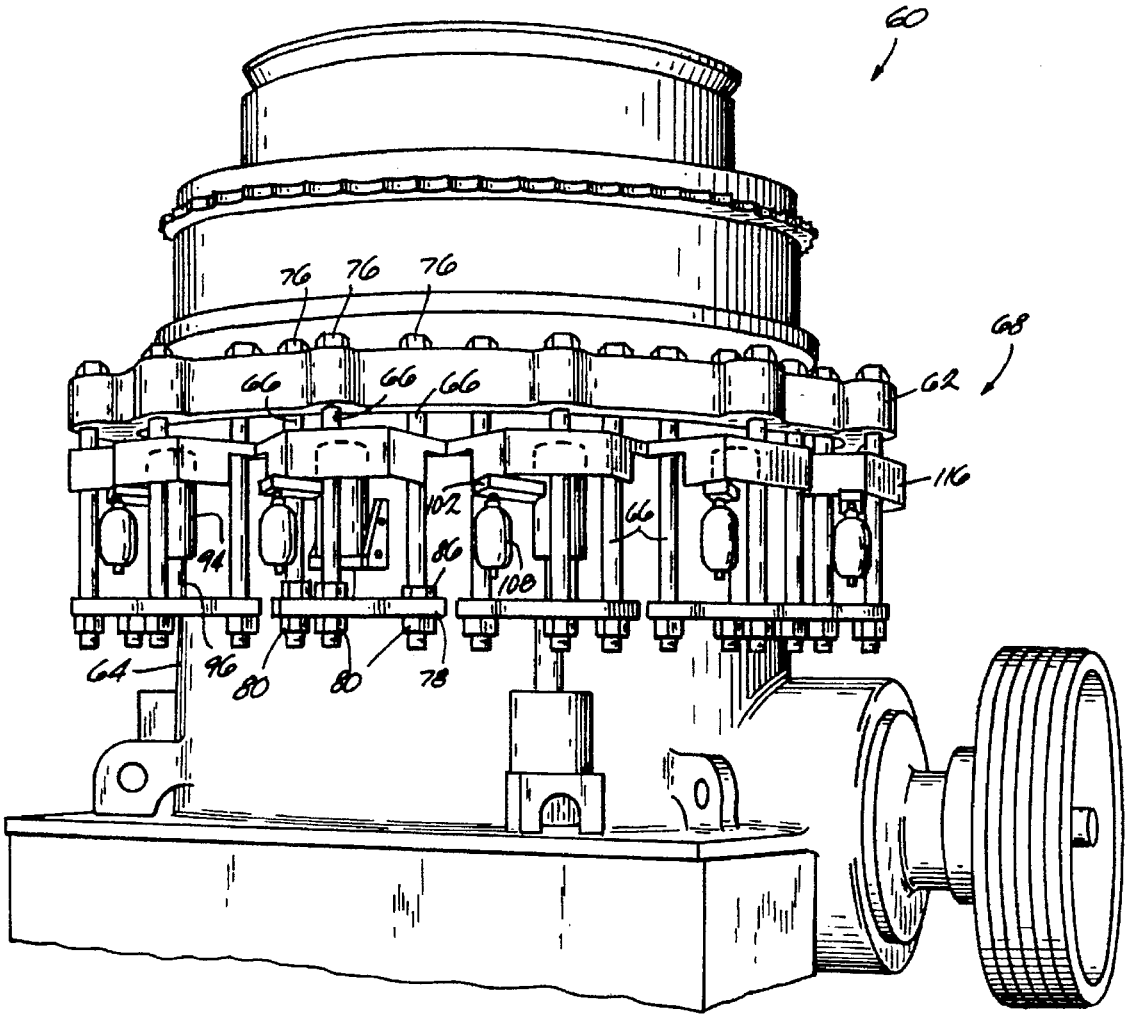
FIG. 3 is a perspective view of a cone crusher embodying the present invention.

As with the above-described prior art cone crusher 12 illustrated in FIGS. 1 and 2, the cone crusher 60 includes spring bolts 66 extending downward from the adjustment ring 62. Three spring bolts 66 are associated with each single-acting subassembly and each double-acting assembly. Each spring bolt 66 extends through the adjustment ring 62 with a spring bolt head 76 holding each spring bolt 66 in place (FIGS. 3 and 6). The spring bolts 66 extend down from the adjustment ring 62 and through a lower spring segment 78. Each spring bolt 66 further includes a lower nut 80 for holding the lower spring segment 78 in place relative to the spring bolt 66.

The spring bolts 66 associated with the single-acting subassemblies interconnect the adjustment ring 62 and the lower spring segment 78 as described above. The spring bolts 66 generally allow the lower spring segment 78 to pull down on the adjustment ring 62, and further allow the adjustment ring 62 to pull up on the lower spring segment 78 (FIG. 3). However, these spring bolts 66 neither facilitate the lower spring segment 78 pushing up on the adjustment ring 62 nor facilitate the adjustment ring pushing down on the lower spring segment 78.

Figure 7:
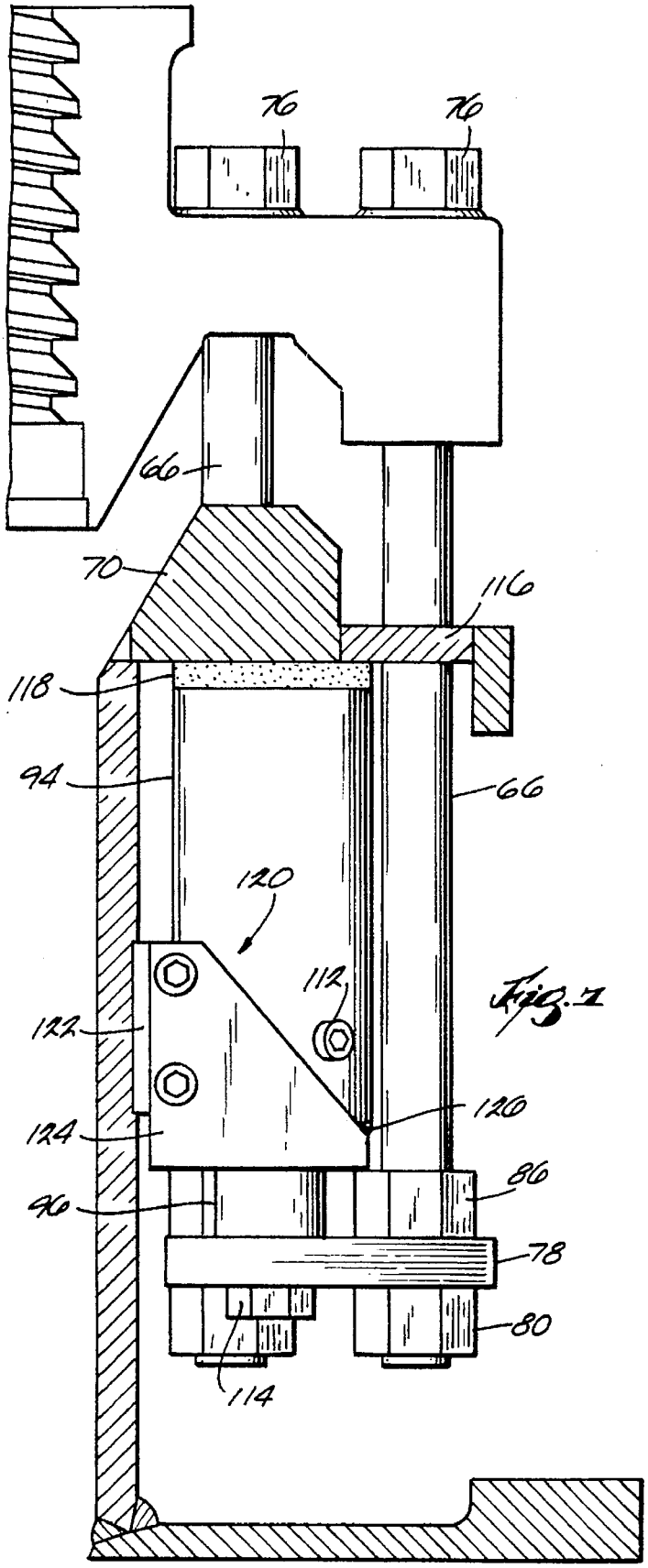
FIG. 7 is the side section view of FIG. 6 with the hydraulic spring in the clear position.
Figure 8:
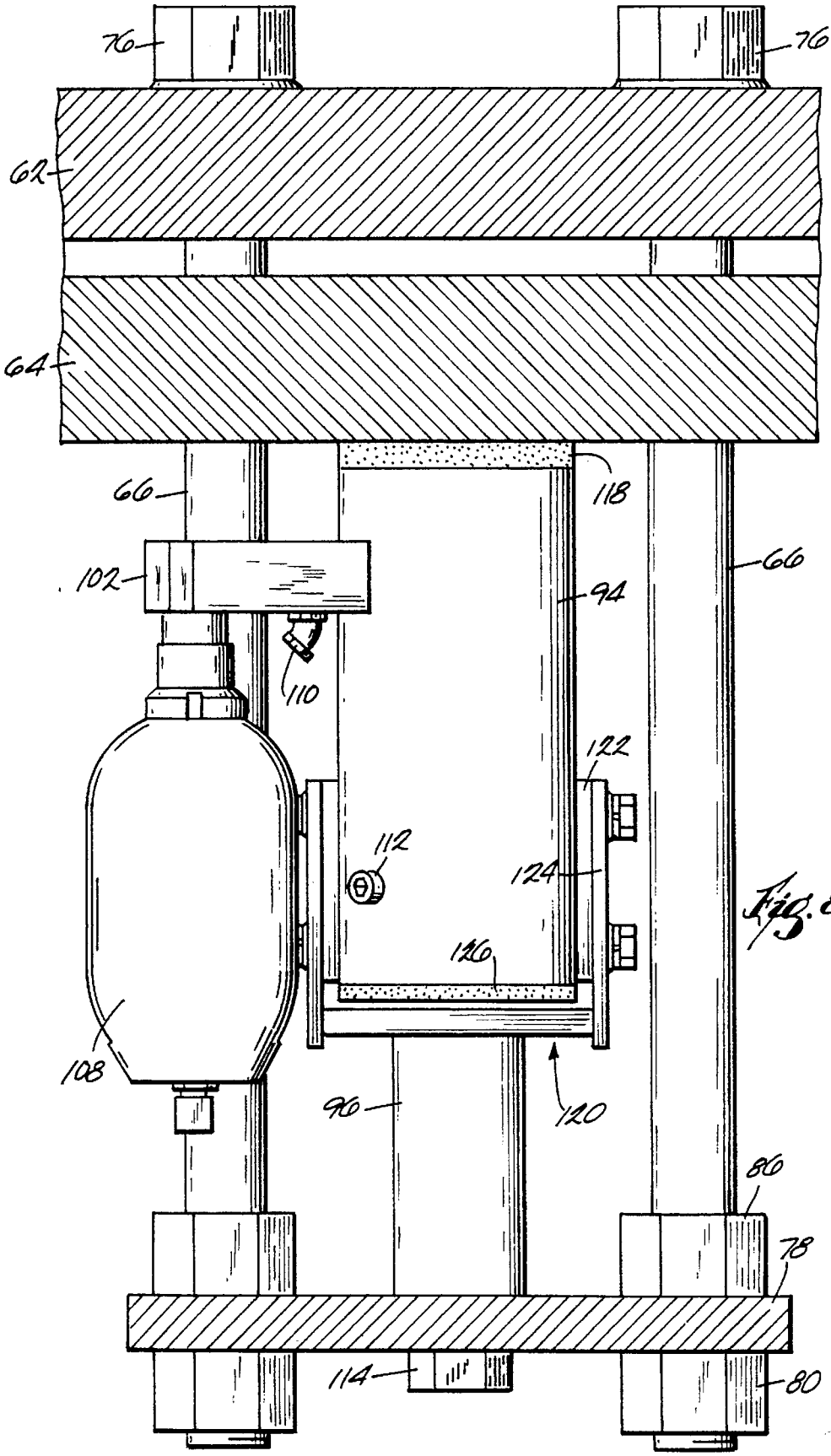
FIG. 8 is a side view of a spring assembly taken along line 8—8 in FIG. 4.

In contrast, the spring bolts 66 associated with the double-acting subassemblies are secured to the adjustment ring 62 and the lower spring segment 78 so as to allow the adjustment ring 62 and the lower spring segments 78 to act on each other in both upward and downward directions. In the illustrated embodiment, this is accomplished by welding the corresponding spring bolt heads 76 to the adjustment ring 62, and further by providing upper nuts 86 immediately above the lower spring segments 78 (FIGS. 6–8).

An upper fluid port 110 (FIG. 8) provides communication between the upper chamber 98 and an external hydraulic circuit, as is described below. In addition, each double-acting subassembly 92 further includes a lower fluid port 112 for providing communication between the lower chamber 100 and the hydraulic circuit, as described below in more detail. In is this communication between the lower chamber 100 and the hydraulic circuit that enables the double-acting subassembly 92 to act as a double-acting hydraulic lift (i.e., capable of acting as a spring in one direction and a lift in the opposite direction).

The piston member 96 of each spring subassembly is interconnected with the corresponding lower spring segment 78 such that upward and downward movement of the piston member 96 causes upward and downward movement of the lower spring segment 78, the associated spring bolts 66 and the adjustment ring 62, and vice versa. In the illustrated embodiment, each piston member 96 is butted against the upper surface of the corresponding lower spring segment 78. A piston bolt 114 is provided to secure each piston member 96 to the corresponding lower spring segment 78.

The upper end of each cylinder member 94 is butted against an upper frame flange 116 of the main frame 64 with a resilient upper pad 118 positioned therebetween. The upper pad 118 is secured to the top of the cylinder member 94 utilizing an epoxy adhesive. The upper pad 118 provides a flexible mounting that assists in maintaining alignment between the cylinder member 94 and the piston member 96 during crushing operations, and further absorbs vibration during crushing operations. More specifically, as noted above, when small tramp is encountered during crushing operations, the adjustment ring 62 will raise slightly to allow the tramp to pass. In reality, only one side of the adjustment ring 62 raises, while the other side remains seated, thereby placing the spring bolts 66 out of alignment with the main frame. Such misalignment is transferred to the piston member 96 through the lower spring segment 78, and can result in misalignment between the piston member 96 and the cylinder member 94, resulting in fluid leakage. By virtue of the flexible mounting provided by the upper pad 118, the cylinder member 94 will remain aligned with the piston member 96, thereby inhibiting fluid leakage. In addition, vibrational forces will be absorbed, thereby extending component life.

Each of the four double-acting subassemblies 92 includes a support structure 120 secured to the main frame 64. Each support structure 120 includes two support brackets 122 welded to the main frame 64, and a support flange 124 secured to the two support brackets 122. The support flange 124 supports the lower end of the cylinder member 94 with a resilient lower pad 126 positioned therebetween. The lower pad 126 helps to maintain alignment of the cylinder member 94 with the piston member 96 while the adjustment ring 62 is raised to the clear position, and further absorbs vibration, as is generally discussed above with reference to the resilient upper pad 118. None of the twelve single-acting subassemblies 90 includes a support structure 120 or a lower pad 126.

In the illustrated embodiment, the upper and lower pads 118, 126 are made from a resilient laminated fabric pad sold under the trademark Fabreeka, by Fabreeka International, Inc., and include an elastomeric compound. The pads have a Shore A Durometer hardness of about 90 and a damping constant of about 0.14. The upper pad is about 25 mm thick and the lower pad is about 12.5 mm thick.

Figure 9:
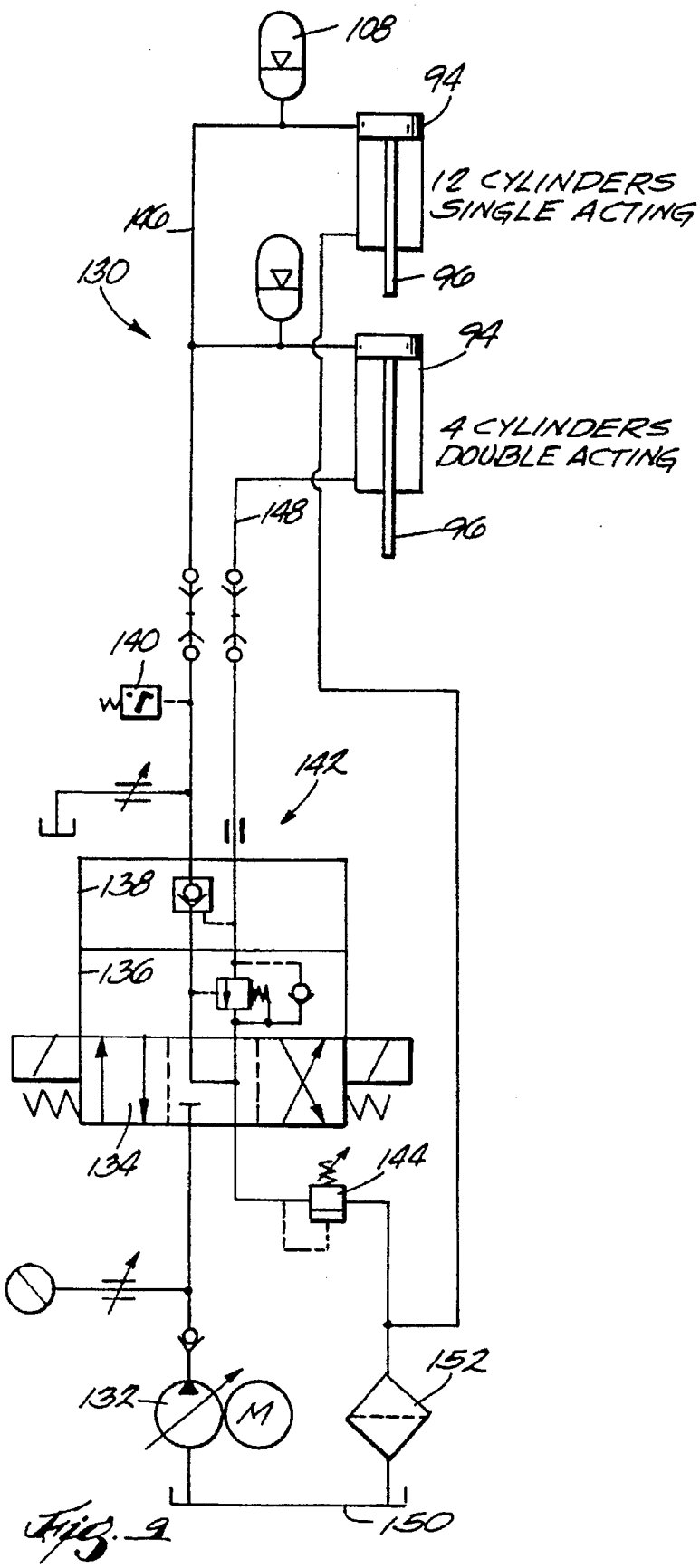
FIG. 9 is a schematic representation of the hydraulic circuit.

Referring to the schematic representation shown in FIG. 9, the hydraulic circuit 130 of the illustrated embodiment includes a hydraulic pump 132, a three position control valve 134, a counterbalance valve 136, a pilot operated check valve 138, a pressure switch 140, a release orifice 142, a relief valve 144, an upper fluid line 146, a lower fluid line 148, a fluid tank 150, and a fluid filter 152. The control valve 134 is movable between a neutral position (shown in FIG. 8), an operating position, and a clear position. In the neutral position, no pressure is supplied beyond the control valve 134.

During crusher operation, the control valve 134 is moved to the operating position. In the operating position, the upper fluid line 146 is pressurized by the hydraulic pump 132 to thereby apply hydraulic pressure to the upper chambers 98 of each spring subassembly. The hydraulic pressure produces a downward force on each piston member 96, resulting in a downward force on the adjustment ring. Once the pressure within the hydraulic circuit 130 reaches about 2000 psi, the pressure switch 140 signals the hydraulic pump 132 to shut down. Pressure of about 2000 psi is trapped between the check valve 138 and the upper chambers 98.

While crushing, the crusher may encounter non-crushable tramp and consequently cause the adjustment ring to lift slightly from its resting position. Such lifting of the adjustment ring causes the piston members 96 to retract into the cylinder member 94, thereby pushing fluid into the accumulators 108. Once the tramp has exited the crusher, the accumulators 108 direct the oil back into the upper chambers 98. If the system returns to less than 2000 psi, the pressure switch 140 will signal the hydraulic pump 132 to start pumping to bring the pressure back to 2000 psi. Whenever the hydraulic pump 132 is operating to re-pressurize the hydraulic circuit 130, an audible alarm (not shown) is activated to notify the operator of the crusher that hydraulic pressure was lost.

When tramp needs to be cleared from the crusher, the operator will put the crusher in the clear mode with the control valve 134 in the clear position. In this mode, hydraulic pressure to the upper fluid line 146 is reduced to 5 psi due to the relief valve 144. The back pressure maintained by the relief valve 144 insures contact between the cylinder members 94, the upper pads, and the main frame upper flange. Pressurized fluid is provided to the lower chambers 100 of the double-acting subassemblies via the lower fluid ports. The result is that the four double-acting subassemblies will lift the adjustment ring to the clear position. In addition, the piston members 96 of the twelve single-acting subassemblies are forced into the corresponding cylinder members 94. The release orifice 142 controls the speed at which the adjustment ring raises. In the illustrated embodiment, the adjustment ring can be raised to about 5 inches.

After clearing the tramp, the system is returned to the operating mode by moving the control valve 134 back to the operating position. The counterbalance valve 136 is provided to prevent the adjustment ring from slamming down onto the main frame due to its own weight when the system is switched from the clearing mode to the operating mode. More specifically, the counterbalance valve 136 is biased to prevent pressure from leaving the lower chambers 100 of the double-acting subassemblies until pressure exists in the upper chambers 98. This feature also prevents the adjustment ring from slamming down onto the main frame in the event of a hydraulic circuit failure.

The hydraulic cone crusher 60 described above with reference to FIGS. 3–8 can be produced by modifying the prior art cone crusher 12 described above with reference to FIGS. 1 and 2. In this regard, the spring bolts 54, spring nuts 56, lower spring segments 50, adjustment ring 26, and upper frame flange 48 illustrated in FIGS. 1 and 2 are the same as the spring bolts 66, lower nuts 80, lower spring segment 78, adjustment ring 62, and upper frame flange 116 illustrated in FIGS. 3–8, except with the modifications noted below.

The modification of the prior art cone crusher 12 can be performed as follows. Referring to FIGS. 1 and 2, with the lower spring segments jacked up using a hydraulic jack (not shown), the three lower spring nuts 56 are removed from each of the coil spring assemblies 44. The jacks are subsequently lowered and the lower spring segments 50 are removed along with the coil springs 52. The lower surface of the upper frame flange 48 is inspected to insure that it is smooth, and the lower surface is ground if necessary. The two support brackets 122 (FIG. 6) are then welded to the main frame 64, and the double-acting spring bolts 66 are welded to the adjustment ring 62. It should be appreciated that the above-described welding operations could be performed by any appropriate securing operation, such as pinning, bolting, screwing, or any other suitable operation.

A hole is drilled in each lower spring segment 78, and the piston bolt 114 is inserted through each hole and into the corresponding piston member 96 to secure the piston member 96 to the corresponding lower spring segment 78. The upper nuts 86 are threaded onto each of the double-acting spring bolts 66. The lower spring segments 78 (and associated pistons and cylinders) are then positioned onto the spring bolts 66, and the lower nuts 80 are installed. The four double-acting subassemblies are then secured in place by screwing the support flanges 124 to the corresponding support brackets 122. Hydraulic hosing (not shown) is subsequently interconnected with the upper fluid port 110 and lower fluid port 112. Finally, the old alignment pins 31 are removed and replaced with new, longer alignment pins (not shown) that extend above the adjustment ring 62 by about 75 mm when the adjustment ring 62 is in the operating position. The new alignment pins 128 are longer to accommodate the increased distance that the hydraulic spring assembly 68 raises the adjustment ring 62. The old hydraulic actuators 58 are not utilized on the modified cone crusher 60. Accordingly, the old hydraulic actuators 58 can be removed or, alternatively, can be left in place in an inactive state.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A cone crusher comprising:

a main frame;

a first crusher member interconnected with said main frame;

a second crusher member positioned adjacent to said first crusher member, said second crusher member being movable relative to said first crusher member between an operating position and a clear position; and a double-acting hydraulic lift interconnected with both said main frame and said second crusher member, said hydraulic lift including a plurality of subassemblies, each subassembly including a cylinder member, a piston housed by said cylinder member and each subassembly including a respective accumulator in fluid communication with said cylinder member.

2. A cone crusher as claimed in claim 1, wherein said second crusher member is positioned above said first crusher member, wherein said cone crusher further comprises a force transfer member interconnected with and extending downward relative to said second crusher member, wherein said hydraulic lift has an upper end interconnected with said main frame and a lower end interconnected with said force transfer member, wherein said hydraulic lift provides a downward clamp force on said force transfer member to compliantly clamp said second crusher member to said main frame in said operating position, and wherein said hydraulic lift provides an upward lift force on said force transfer member to move said second crusher member from said operating position to said clear position.

3. A cone crusher as claimed in claim 1, further comprising a resilient pad operatively positioned between said hydraulic lift and said main frame.

4. A cone crusher as claimed in claim 1, wherein said hydraulic lift is at least partially positioned between first and second flanges of said main frame.

5. A cone crusher as claimed in claim 4, further comprising:

a first resilient pad positioned between said hydraulic lift and said first flange; and a second resilient pad positioned between said hydraulic lift and said second flange.

6. A cone crusher as claimed in claim 1, wherein said first crusher member comprises a crusher head rotatably interconnected with said main frame.

7. A cone crusher as claimed in claim 1, wherein said second crusher member comprises a crusher bowl.

8. A cone crusher as claimed in claim 1, wherein said second crusher member includes an adjustment ring.

9. A cone crusher comprising:

a main frame;

a first crusher member interconnected with said main frame;

a second crusher member positioned above said first crusher member, said second crushing member being movable relative to said first crusher member between an operating position and a clear position;

a force transfer member interconnected with and extending downward relative to said second crusher member; and a hydraulic spring assembly including a plurality of cylinder members, each cylinder member having an upper end interconnected with said main frame and a lower end interconnected with said force transfer member, said hydraulic spring also including a plurality of accumulators associated with said cylinder members, said hydraulic spring providing a downward clamp force on said force transfer member to compliantly clamp said second crusher member to said main frame during crushing operations.

10. A cone crusher as claimed in claim 9, further comprising a resilient pad operatively positioned between said cylinder member and said main frame.

11. A cone crusher as claimed in claim 10, wherein said hydraulic spring is at least partially positioned between first and second flanges of said main frame.

12. A cone crusher as claimed in claim 11, further comprising:

a first resilient pad positioned between said cylinder member and said first flange; and a second resilient pad positioned between said cylinder member and said second flange.

13. A cone crusher as claimed in claim 9, wherein said first crusher member comprises a crusher head rotatably interconnected with said main frame.

14. A cone crusher as claimed in claim 9, wherein said second crusher member comprises a crusher bowl.

15. A cone crusher as claimed in claim 9, wherein said second crusher member includes an adjustment ring.

16. A cone crusher as claimed in claim 9, further comprising a lower spring segment interconnecting said lower end of said cylinder member with said force transfer member.

17. A cone crusher as claimed in claim 9, wherein said hydraulic spring comprises a double-acting hydraulic lift.

18. A cone crusher comprising:

a main frame;

a first crusher member interconnected with said main frame;

a second crusher member positioned adjacent to said first crusher member, said second crusher member being movable relative to said first crusher member between an operating position and a clearing position;

a hydraulic spring interconnected with both said main frame and said second crusher member, said hydraulic spring providing a clamp force on said second crushing member to compliantly clamp said second crusher member to said main frame during crushing operations; and a resilient pad operatively positioned between said hydraulic spring and said main frame.

19. A cone crusher as claimed in claim 18, wherein said hydraulic spring is at least partially positioned between first and second flanges of said main frame.

20. A cone crusher as claimed in claim 19, further comprising:

a first resilient pad positioned between said hydraulic spring and said first flange; and a second resilient pad positioned between said hydraulic spring and said second flange.

21. A cone crusher as claimed in claim 18, wherein said resilient pad comprises an elastomeric compound.

22. A cone crusher as claimed in claim 18, wherein said hydraulic spring comprises a double-acting hydraulic lift.

23. A cone crusher as claimed in claim 18, wherein said first crusher member comprises a crusher head rotatably interconnected with said main frame.

24. A cone crusher as claimed in claim 18, wherein said second crusher member comprises a crusher bowl.

* * * * *